US005087947A

United States Patent [19]

Torino

[11] Patent Number: 5,087,947

[45] Date of Patent: Feb. 11, 1992

[54] HEAT-FIXING APPARATUS

[75] Inventor: Mitsuyasu Torino, Fukaya, Japan

[73] Assignee: Hitachi Metals, Ltd., Tokyo, Japan

[21] Appl. No.: 564,086

[22] Filed: Aug. 7, 1990

[30] Foreign Application Priority Data

Aug. 9, 1989 [JP] Japan ..... 1-206080

[51] Int. Cl.[5] ..... G03G 15/20

[52] U.S. Cl. ..... 355/290; 219/216

[58] Field of Search ..... 355/282, 284, 285, 286, 355/289, 290; 219/216, 388; 432/59, 60; 118/60

[56] References Cited

U.S. PATENT DOCUMENTS

| | | | |
|---|---|---|---|
| 4,367,690 | 1/1983 | Sakaguchi et al. | 432/60 |
| 4,696,561 | 9/1987 | Katoh et al. | 219/216 X |
| 4,899,197 | 2/1990 | Davis et al. | 355/282 X |

FOREIGN PATENT DOCUMENTS

| | | | |
|---|---|---|---|
| 2652731 | 5/1977 | Fed. Rep. of Germany | 355/290 |
| 59-176766 | 10/1984 | Japan | 355/290 |

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

Heat-fixing apparatus including a heat roll and a pressure roll and a pressure roll which are rotatable in a pressed contact state for heat fixing of toner image carried on a continuous paper and defining a gap an introduction guide disposed upstream of the heat roll and the pressure roll for guiding the continuous paper into a gap between the heat roll and the pressure roll; and a pair of paper-discharging rolls disposed downstream of the heat roll and the pressure roll and rotatable in a pressed contact state and defining a gap for permitting the continuous paper to pass therethrough. The pressure roll is movable away from the heat roll, and the gap between the heat roll and the pressure roll is located above a plane including a downstream end of the introduction guide and the gap between the pair of paper-discharging rolls. The pair of paper-discharging rolls provide tension to the continuous paper when the pressure roll moves away from the heat roll, so that the continuous paper separates not only from the heat roll but also from the pressure roll.

5 Claims, 1 Drawing Sheet

HEAT-FIXING APPARATUS

BACKGROUND OF THE INVENTION

The present invention relates to an apparatus for heat-fixing toner image onto papers or other sheets in image-forming apparatuses such as electrophotographic apparatuses and electrostatic printing apparatuses, and more particularly to a heat-fixing apparatus suitable for printers for printing continuous papers such as rolled papers and folded papers as output apparatuses of computers.

Conventionally used to fix toner image onto recording media or carrier sheets such as zinc oxide photoconductive papers, plain papers, plastic sheets, etc., is a heat-fixing apparatus comprising a heat roll and a pressure roll rotatably disposed opposite to each other in a pressed contact state, through which the carrier sheets bearing toner image pass while being heated under pressure. In such an apparatus a pressure roll having an outer surface layer made of a heat-resistant elastic material is disposed opposite to the heat roll and kept in a pressed contact state to have a predetermined contact width or nip width between the two rolls. Such a heat-fixing apparatus is used in conventional electrophotographic apparatuses, for instance, copying machines, in which the heat-fixing apparatus is in cooperation with an electrostatic image-developing apparatus for fixing toner image onto cut papers. In recent years, they are used as printers for fixing toner image onto continuous papers such as rolled papers or folded papers in cooperation with the output apparatuses for computers.

In a heat-fixing apparatus using continuous papers, to stop fixing operation, a heat-generating source and a driving source should be inactivated, and a continuous paper should be separated from the heat roll. That is, unlike a heat-fixing apparatus using usual cut papers, mere inactivation of the heat-generating source and the driving source leads to undesirable heating, and scorching in extreme cases, of the continuous paper by the heat roll, because the continuous paper is kept between the heat roll and the pressure roll, so that it is heated by the heat roll. Accordingly, the pressure roll should be separated from the heat roll in a non-printing period. However, mere separation of the pressure roll from the heat roll does not necessarily enable the continuous paper to be separated from the heat roll.

FIG. 2 is a schematic view showing a conventional heat-fixing apparatus. In this figure, 1 and 2 respectively denote a heat roll and a pressure roll, which are rotatable in a pressed contact state. It comprises an introduction guide 3 on the upstream side of the pressure roll 2 and a pair of paper-discharging rolls 4 rotatable in a pressed contact state disposed on the downstream side of the pressure roll 2. 5 denotes a discharge guide.

By the above structure, a continuous paper 6 bearing toner image is introduced between the heat roll 1 and the pressure roll 2 by the introduction guide 3 to carry out the fixing of toner image, and then discharged via the discharge guide 5 and a pair of the paper-discharging rolls 4. In the case of stopping the fixing operation, namely in a non-printing period, the heat roll 1 and the pressure roll 2 are separated vertically. However, the continuous paper 6 is not separated from the heat roll 1 because of the structure of the heat-fixing apparatus and physical attraction and adhesion between the heat roll and the continuous paper 6. Specifically speaking, since a downstream end 3*a* of the introduction guide 3, a gap between the heat roll 1 and the pressure roll 2 and a gap between a pair of the paper-discharging rolls 4 are substantially on the same plane, the continuous paper 6 cannot be released from the heat roll 1 only by moving the pressure roll 2 downward. Also, since the continuous paper 6 is electrostatically charged in the preceding image transfer process, it is likely to be attracted to the heat roll 1. In addition, there is adhesion due to toner between the continuous papers 6 and the heat roll 1. Accordingly, the continuous paper 6 is still kept in contact with the heat roll 1 even when the pressure roll 2 moves downward to permit the continuous paper 6 to sag.

OBJECT AND SUMMARY OF THE INVENTION

An object of the present invention is to provide a heat-fixing apparatus free from the above problems inherent in the conventional technologies, namely, capable of preventing the heating and scorching of the continuous paper in a non-printing period.

The present invention provides a heat-fixing apparatus comprising:

(a) a heat roll and a pressure roll which are rotatable in a pressed contact state for heat fixing of toner image carried on a continuous paper;

(b) an introduction guide disposed upstream of the heat roll and the pressure roll for guiding the continuous paper into a gap between the heat roll and the pressure roll; and (c) a pair of paper-discharging rolls disposed downstream of the heat roll and the pressure roll and rotatable in a pressed contact state for permitting the continuous paper to pass therethrough;

the pressure roll being movable away from the heat roll, and a gap between the heat roll and the pressure roll being located above a plane including a downstream end of the introduction guide and a gap between the pair of paper-discharging rolls, whereby the pair of paper-discharging rolls provide a tension to the continuous paper when the pressure roll moves away from the heat roll, so that the continuous paper can be separated not only from the heat roll but also from the pressure roll.

In the present invention, the pressure roll can preferably be separated rom the heat roll by 4 mm or more.

The introduction guide and/or a pair of the paper-discharging rolls may be movable vertically together with the pressure roll.

DETAILED DESCRIPTION OF THE INVENTION

Figure 1:
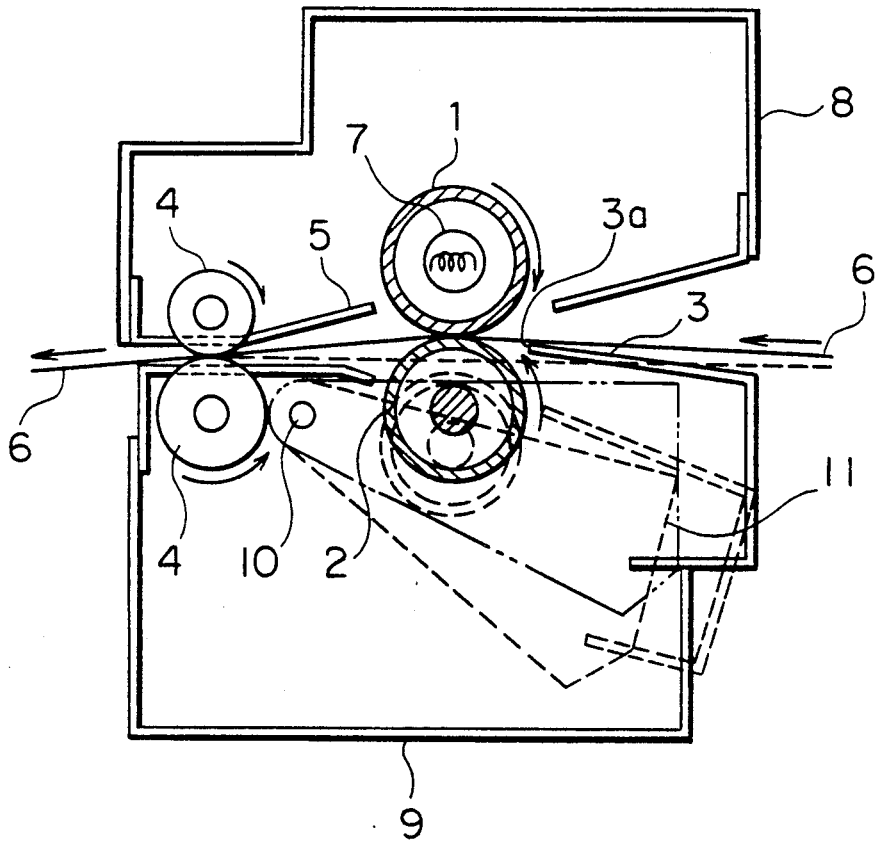
FIG. 1 is a schematic cross-sectional view showing a heat-fixing apparatus according to one embodiment of the present invention.
Figure 2:
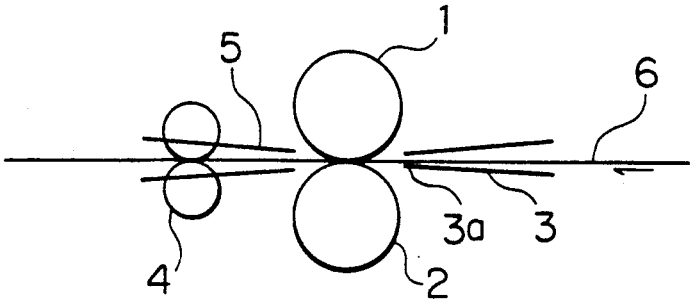
FIG. 2 PRIOR ART
FIG. 2 is a schematic view showing a conventional heat-fixing apparatus.

FIG. 1 is a schematic cross-sectional view showing a heat-fixing apparatus according to an embodiment of the present invention, in which the same reference numerals are assigned to the same parts as in FIG. 2. In FIG. 1, a heat roll 1 comprises a hollow cylinder made of materials with good thermal conductivity such as aluminum alloys, etc. and provided with a release layer (not shown) made of fluorine resin materials such as PFA, PTFE, etc., and a heat-generating source 7 contained in the hollow cylinder. A pressure roll 2 comprises a hollow cylinder made of materials with good thermal conductivity and provided with a resilient layer ( not shown) such as silicone rubber. etc. The heat roll 1 is rotatably mounted in an upper frame 8. A pressure roll 2 is rotatably mounted to a movable frame 11 which is pivotably mounted to a lower frame 9 via a shaft 10. Incidentally, the movable frame 11 is provided with a pressure spring (not shown) for pressing the pressure roll 2 to the heat roll 1. A gap between the heat roll 1 and the pressure roll 2 is located above a plane including a downstream end 3*a* of the introduction guide 3 and a gap between a pair of paper-discharging rolls 4, 4.

In a printing period, the heat roll 1 and the pressure roll 2 are in a pressed contact with each other as shown by the solid line in FIG. 1, and the heat-generating source 7 is energized. A continuous paper 6 carrying toner image on a top surface thereof is supplied in the direction shown by the arrow, and introduced between the heat roll 1 and the pressure roll 2 to carry out the fixing of toner image onto the continuous paper 6. On the other hand, in a non-printing period, the heat-generating source 7 in the heat roll 1 is inactivated, and the heat roll 1 and the pressure roll 2 are stopped. The movable frame 11 is rotated clockwise around the shaft 10, for instance, by 15° (see the broken line in FIG. 1). Since the pressure roll 2 swings downward by the rotation of the movable frame 11, the pressure roll 2 is released from the pressed contact state with the heat roll 1. Next, by rotating a pair of the paper-discharging rolls 4, 4, for instance, for 1–2 seconds, tension is applied to the continuous paper 6 by the paper-discharging rolls 4, 4, so that the continuous paper 6 is made straight as shown by the broken line. As a result, it is separated from the heat roll 1. Accordingly, it is protected from heating and scorching due to the heat of the heat roll 1. Incidentally, with respect to the separation distance of the pressure roll 2 from the heat roll 1, it is preferably 4 mm or more to prevent the heat of the heat roll 1 from being transmitted to the continuous paper.

In the above embodiment, the pressure roll and the introduction guide are operated simultaneously, but only the pressure roll may be movable up and down. Alternatively, the introduction guide and a pair of the paper-discharging rolls may be movable up and down together with the pressure roll. Further, as a means for applying a tension to the continuous paper in a non-printing period, it is not restricted to a pair of the paper-discharging rolls, but it may be a pin tractor engageable with the continuous paper. Or both of them may be used in combination.

As described above, since the heat-fixing apparatus of the present invention comprises a pressure roll which surely enables a continuous paper to be separated from a heat roll in a non-printing period, heating and scorching of the continuous paper due to heat conduction from the heat roll can be completely prevented. In addition, heat fixing can be smoothly restarted only by moving the pressure roll upward.

What is claimed is:

1. A heat-fixing apparatus comprising:

(a) a heat roll and a pressure roll which are rotatable in a pressed contact state for heat fixing of toner image carried on a continuous paper and for defining a first gap through which said paper passes during heat fixing;

(b) an introduction guide disposed upstream of said heat roll and said pressure roll for guiding said continuous paper into said first gap between said heat roll and said pressure roll; and (c) a pair of paper-discharging rolls disposed downstream of said heat roll and said pressure roll, rotatable in a pressed contact state, and defining a second gap for permitting said continuous paper to pass therethrough;

said pressure roll being movable away from said heat roll, wherein said heat-fixing apparatus further includes means for preventing scorching of said continuous paper by said heat roll during non-fixing periods of operation, said means including said first gap between said heat roll and said pressure roll being located above a plane including a downstream end of said introduction guide and said second gap between said pair of paper-discharging rolls, said pair of paper-discharging rolls providing tension to said continuous paper when said pressure roll moves away from said heat roll, so that said continuous paper separates not only from said heat roll but also from said pressure roll.

2. The heat-fixing apparatus according to claim 1, wherein said pressure roll is separable from said heat roll by 4 mm or more.

3. The heat-fixing apparatus according to claim 1, wherein said introduction guide and/or said pair of paper-discharging rolls are movable up and down together with said pressure roll.

4. The heat-fixing apparatus according to claim 1, wherein said pressure roll is rotatably supported by a movable frame which is pivotally supported by a frame of said heat-fixing apparatus, whereby said pressure roll is movable away from said heat roll by rotating said movable frame.

5. The heat-fixing apparatus according to claim 4, wherein said introduction guide is fixed to said movable frame, whereby when said movable frame rotates downward, said introduction guide also moves downward so that said continuous paper is separated from said pressure roll and said heat roll.

* * * * *